United States Patent [19]

Stirling

[11] Patent Number: 5,007,861

[45] Date of Patent: Apr. 16, 1991

[54] CRIMPLESS COAXIAL CABLE CONNECTOR WITH PULL BACK CABLE ENGAGEMENT

[75] Inventor: Albert Stirling, Gormley, Canada

[73] Assignee: Stirling Connectors Inc., Markham, Canada

[21] Appl. No.: 532,292

[22] Filed: Jun. 1, 1990

[51] Int. Cl.[5] ..... H01R 13/00

[52] U.S. Cl. ..... 439/578

[58] Field of Search ..... 439/578–585

[56] References Cited

U.S. PATENT DOCUMENTS

| | | | |
|---|---|---|---|
| 4,339,166 | 7/1982 | Dayton | 439/578 |
| 4,746,305 | 5/1988 | Nomura | 439/578 |
| 4,902,246 | 2/1990 | Samchisen | 439/578 |

*Primary Examiner*—Joseph H. McGlynn
*Attorney, Agent, or Firm*—Rogers, Bereskin & Parr

[57] ABSTRACT

A crimpless coaxial cable connector is provided which can be secured to a cable simply by pushing the cable into the connector and subsequently pulling it back. The body of the connector has a bushing mounted within it near the cable receiving end having a diameter to closely receive the cable. The body of the connector also has within it an annular mandrel having a bore to receive the stripped core of the cable, and having a sleeve adapted to engage the cable beneath the jacket by pushing the cable and the mandrel together. This stretches the jacket of the cable to a diameter greater than the internal diameter of the bushing. The mandrel is movable from a position in which the sleeve is ot surrounded by the bushing in which the sleeve may be engaged to the cable, to a position in which the sleeve is at least partially within the bushing in which the jacket is frictionally engaged by the bushing, by pulling the cable away from the connector after it has been pushed onto the mandrel sleeve. Preferably, the mandrel is displaced to further tighten the frictional engagement of the jacket by the bushing by screwing the connector onto a threaded coupling unit.

12 Claims, 2 Drawing Sheets

CRIMPLESS COAXIAL CABLE CONNECTOR WITH PULL BACK CABLE ENGAGEMENT

FIELD OF THE INVENTION

This invention relates generally to a connector for coaxial cable, such as the type used for cable TV transmission. More particularly, this invention relates to a crimpless connector for coaxial cable.

BACKGROUND OF THE INVENTION

Conventional coaxial cable connectors require that the connector be crimped to the cable to secure the connector to the cable. Such connectors suffer from two main disadvantages. First, crimping requires a crimping tool. This can be inconvenient because the tool may not be readily available, and in any event, such tools wear out with repeated use. Operators such as cable television installers typically require frequent replacement of their crimping tools. Second, crimping the connector around the cable does not provide a satisfactory seal. Crimped connectors typically permit leakage of radiation, and moisture penetration (which can interfere with signal transmission and which also exacerbates radiation leakage).

Certain crimpless connectors have recently been developed which attempt to overcome these problems.

One type of crimpless connector receives a plastic bushing, which is first broken away from a plastic ring mounted on the connector, and then slid over the cable and finally inserted into the annular cavity between the inner wall of the connector and the jacket of the cable. A special tool is required to push the bushing in fully. Two main problems exist with this crimpless connector. First, there is again a requirement for a special tool. Second, there is a tendency for the bushings to become lost before being put into use.

A second type of crimpless connector comprises a main body with a cylindrical mandrel having an inclined annular edge. A compressible ferrule is positioned within the cylindrical housing at the neck. The cable is inserted through the neck in the ferrule, with the cylindrical mandrel inserted between the foil and the jacket of the cable. When the connector is screwed onto a corresponding threaded coupling unit and tightened, the coupling unit bears on the end wall of the mandrel, pushing the annular edge towards the compressible ferrule. The ferrule then bears upon the jacket of the cable to provide a frictional engagement. One problem of this connector is that is has very little pull resistance until it is screwed onto a corresponding coupling unit and is thus prone to fall off the cable before it has been so connected. Second, it is difficult to know how tightly this type of connector must be screwed onto the corresponding coupling unit to provide satisfactory pull resistance.

BRIEF SUMMARY OF THE INVENTION

The purpose of the present invention is to obviate or mitigate the disadvantages of the known connectors for coaxial cable. In accordance with the invention, a connector is provided for use with a coaxial cable of the type having a core with a central wire conductor and a foil conductor and having a deformable outer insulating jacket. The connector is intended for use with a coupling unit and comprises a generally cylindrical body which contains a bushing and an annular mandrel. The body is open at both ends, and has a mating portion at one end which is engageable with the coupling unit. At the other end the body is adapted to receive the cable. The bushing has a bore of a diameter to closely receive the cable. It is mounted within the body near the end adapted to receive the cable. The annular mandrel has a bore of a diameter to closely receive the core of the cable, and is housed within the body nearer the end which is engageable with the coupling unit.

The mandrel has a sleeve which is adapted to engage the cable beneath the jacket and contacting the foil, stretching the jacket and increasing its outer diameter greater than the internal diameter of the bushing when the cable and the mandrel are pushed together. The mandrel is movable longitudinally within the body from a receiving position in which the sleeve is not surrounded by the bushing and so may be engaged by the cable, to a holding position in which the sleeve is at least partially within the bushing and the jacket is frictionally engaged by the bushing, thus retaining the cable within the connector. The mandrel is moved from the receiving position to the holding position by pulling the cable away from the connector after the cable has been engaged to the mandrel.

Such a connector can be securely joined to a cable without needing any special tools. The cable is prepared in the usual way, and then simply pushed into the connector and subsequently pulled back. It has surprisingly been found that a very secure fit can be provided simply by the frictional engagement of the cable jacket being wedged between the mandrel and the bushing as the cable is pulled back away from the connector.

In the preferred embodiment, the connector is intended for use with a threaded coupling unit and has a corresponding threaded portion. The mandrel and the bushing are both free to rotate within the connector body. Once the connector has been joined to the cable by pulling the cable away from the connector after engagement of the cable with the mandrel, the connector is then screwed onto the coupling unit, which displaces the mandrel further into the bushing to provide an even tighter engagement. Advantageously, the mandrel includes a collar which is received within an internal recess of the body of the connector, limiting the longitudinal movement of the mandrel, and providing a signal when the connector has been screwed onto the coupling unit to the appropriate position. Most advantageously, the connector also includes an 0-ring which is positioned between the bushing and the end of the connector which receives the cable, and which forms a close fitting seal with the jacket of the cable.

BRIEF DESCRIPTION OF THE DRAWINGS

In order that the invention may be more clearly understood, reference will be made to the accompanying drawings which illustrate a preferred embodiment of the coaxial cable connector of the present invention, and in which.

DESCRIPTION OF THE PREFERRED EMBODIMENT

Figure 1:
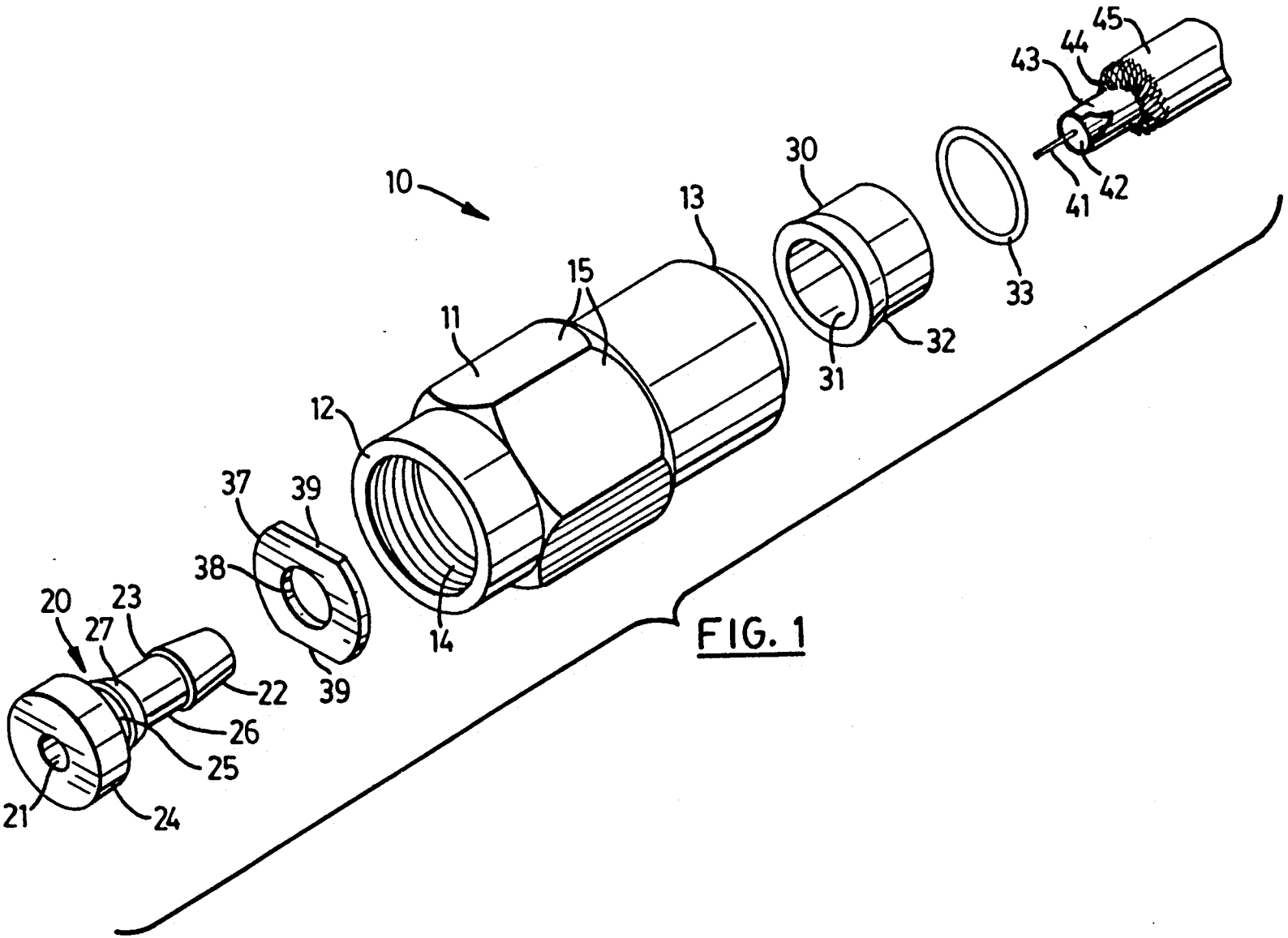
FIG. 1 is an exploded perspective view of a cable connector of the present invention, shown with a coaxial cable.
Figure 2:
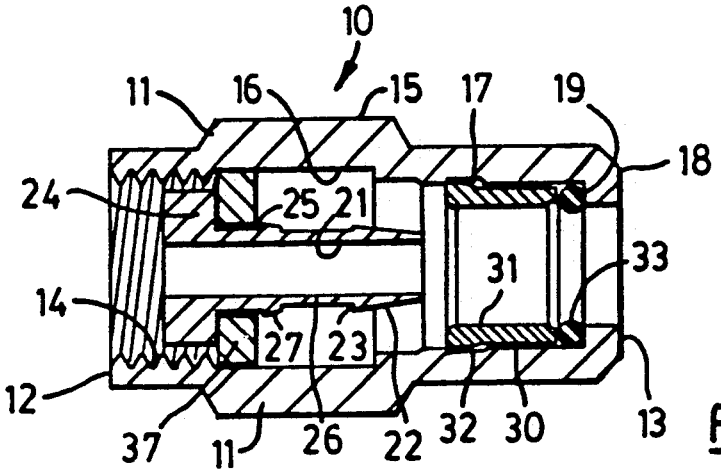
FIG. 2 is a cross-sectional side view of the connector of FIG. 1.

In the drawings, the coaxial cable connector is denoted generally by the reference 10. Referring first to FIGS. 1 and 2, the cable connector 10 comprises a main body 11 which has a first end 12 and a second end 13. The first end 12 has a threaded portion 14 to permit the connector to be screwed on to a corresponding threaded coupling unit. The main body 11 has hexagonal flattened sides 15 to facilitate screwing the connector to such a coupling unit with a wrench. The interior of the cable connector has a first longer recess 16 and a second shorter recess 17. At the second end 13 the cable connector 10 has internally turned shoulders 18 forming an end wall 19.

A bushing 30 has a bore 31 and a flared lip 32 which is retained within the shorter recess 17, permitting rotation and restricted longitudinal movement cf the bushing 30 within the body 11. An 0-ring 33 is positioned between the bushing 30 and the end wall 19. A collar 37, having a hole 38 and opposing flattened sides 39 is positioned within the longer recess 16 and is free to travel within the confines of the longer recess 16. An annular mandrel 20 having a bore 21, a flange 24, and a sleeve 26 is held by the collar 37. The sleeve 26 has a frustoconical end 22, an indentation 23, and a flared portion 27 leading to a recess 25 which is received within the collar 37. The body 11, bushing 30, and mandrel 20 and collar 37 are all brass.

The cable connector 10 is assembled by loading the 0-ring 33 into the connector body through the second end 13 and positioning the 0-ring 33 such that it is seated against the end wall 19. The bushing 30 is then loaded into the connector body 11 through the first end 12 and pushed towards the second end 13. The flared lip 32 of the bushing 30 has an external diameter slightly greater than the internal diameter of the connector body 11 and slightly less than the internal diameter of the shorter recess 17. As the bushing 30 is displaced towards the second end 13, the flared lip 32 contacts the inside wall of the connector body 11. The bushing 30 is rigid, but the flared lip 32 is sufficiently elastically compressible that when force is applied to the bushing 30, the flared lip 32 will compress and can be displaced into the shorter recess 17. The flared lip 32 is then confined within the shorter recess 17 such that the bushing 30 can rotate freely and can travel longitudinally slightly, restrained by the shorter recess 17. The 0-ring 33 is held in place between the bushing 30 and the end wall 19.

The collar 37 is then inserted into the connector body 11 through the first end 12 by orienting the collar 37 such that the opposing flattened sides 39 are parallel to the connector body side walls. Once the collar 37 has been positioned within the longer recess 16, the collar 37 is then re-oriented concentric to the connector 10 such that the opposing flattened sides 39 are perpendicular to the connector body side walls. The external diameter of the collar 37 is slightly less than the internal diameter of the longer recess 16 but greater than the internal diameter of the connector body 11. Thus, when the collar 37 is re-oriented within the connector body 11, the collar 37 is confined within the longer recess 16 such that the collar 37 can rotate freely and travel along the distance of the longer recess 16.

The annular mandrel 20 is then inserted into the first end 12 of the connector body 11 such that the sleeve 26 passes into the hole 38 of the collar 37. The flared portion 27 of the sleeve 26 has a maximum diameter slightly greater than the internal diameter of the hole 38. The external diameter of the recess 25 is slightly less than the internal diameter of the hole 38. As the annular mandrel 20 is pushed through the hole 38, the flared portion 27 and the collar 37 elastically deform sufficiently that when force is applied to the annular mandrel 20, the flared portion 27 is displaced through the hole 38, such that the recess 25 becomes seated within the hole 38 of the collar 37.

The coaxial cable 40 is of a well known type and comprises a central wire conductor 41, a dielectric 42, a foil conductor 43, braided shielding 44 and an outer insulating jacket 45 which is made of a deformable material such as plastic.

Figure 3:
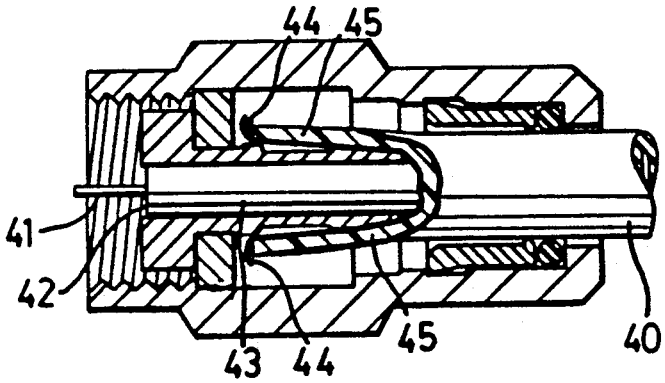
FIG. 3 is a cross-sectional side view of the connector of FIG. 2, shown with a coaxial cable inserted into the connector, engaging the mandrel of the connector.
Figure 4:
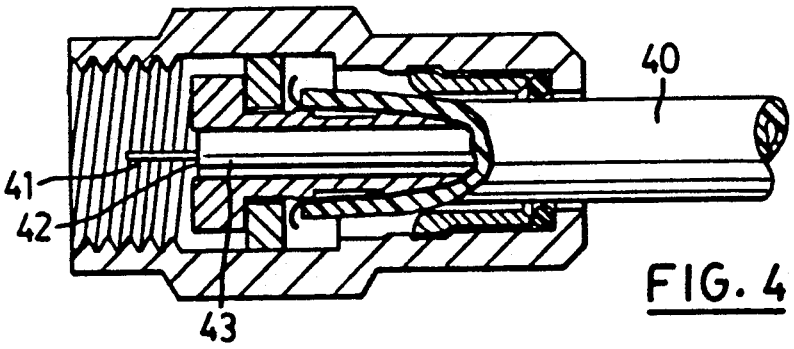
FIG. 4 is a cross-sectional side view of the connector of FIG. 3, shown with the cable subsequently pulled back.
Figure 5:
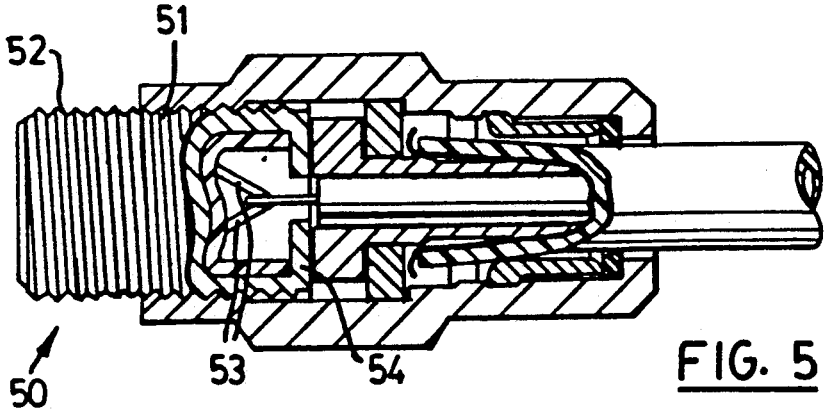
FIG. 5 is a cross-sectional side view of the connector of FIG. 4, shown subsequently screwed onto a coupling unit.

Referring to FIGS. 3–5, the connector 10 is joined to the coaxial cable 40 by first trimming the cable 40 to expose both the wire 41 and the foil 43, as illustrated. The cable 40 is then inserted into the connector 10 through the second end 13 such that the cable 40 passes through the bore 31 of the bushing 30. The annular mandrel 20 is adapted to engage the cable 40 by pushing the two together. When the cable 40 is pushed into the second end 13 of the connector 10 and contacts the end of the sleeve 26, the annular mandrel 20 locates as far from the second end 13 as is permitted by the collar 37 in the longer recess 16, in a position in which the sleeve 26 is completely unsurrounded by the bushing 30. As the cable 40 is pushed further, the sleeve 26 of the annular mandrel 20 then becomes wedged between the foil 43 and the braided shielding 44 of the cable 40, stretching the outer jacket 45 and increasing its diameter greater than the bore 31 of the bushing 30. The frustoconical end 22 and indentation 23 facilitate engagement of the sleeve 26 to the cable 40 and inhibit subsequent disengagement. When the cable 40 is fully pushed onto the sleeve 26, the foil 43, dielectric 42 and central wire 41 extend through the bore 21 of the annular mandrel 20, with the wire 41 extending outwardly beyond the flange 24 of the mandrel 20.

The coaxial cable 40 is then pulled back away from the connector 10. Because the cable 40 has been engaged to the mandrel 20, pulling back on the cable 40 also moves the mandrel 20 toward the bushing 30. The part of the jacket 45 which has been stretched over the sleeve 26 of the mandrel 20 cannot pass back through the bore 31 of the bushing 30. As the sleeve 26 enters within the bore 31, the jacket 45 becomes wedged between the sleeve 26 and the bushing 30, and frictionally engaged by the bushing 30. With the mandrel 20 in this position, the connector 10 is sufficiently secured to the cable 40 to prevent any significant risk of the connector 10 becoming disengaged from the cable 40.

The corresponding mounting unit 50 is of a well known type and comprises a body 51, a threaded portion 52, jaws 53 and insulation 54. As the connector 10 is screwed onto the mounting unit 50, the flange 24 of the annular mandrel 20 is contacted by the end wall of the mounting unit 50, pushing the annular mandrel 20 towards the second end 13 of the connector body 11 until the collar 27 abuts against the end of travel permitted by the longer recess 16. This displacement of the collar 27 and annular mandrel 20 causes further squeezing of the outer insulating jacket 45 between the sleeve 26 and the bushing 30. The positive stop provided by the abutting of the collar 27 against the end wall of the longer recess 16 provides a signal that the connector is fully secured to the cable. As the connector 10 is screwed onto the coupling unit 50, moving the annular mandrel 20 to the positive stop position, the bushing 30 is also displaced toward the 0-ring 33, compressing it longitudinally and causing it to squeeze more tightly around the cable 40.

While the preferred embodiment is designed for use in conjunction with coaxial cable of the type used for television transmission, it is contemplated that other embodiments can be used in conjunction with other coaxial cables. It will of course also be appreciated that many variations are possible within the broad scope of the invention.

I claim:

1. A connector for use with a coaxial cable of the type having a core with a central wire conductor and a foil conductor and having a deformable outer insulating jacket, said connector also being for use with a threaded coupling unit, said connector comprising:

a generally cylindrical body open at both ends, having a threaded portion at one end engageable with said coupling unit, and at the other end being adapted to receive said cable;

a rigid bushing with a bore of a diameter to closely receive said cable, mounted within said body proximal to said other end thereof;

an annular mandrel with a bore of a diameter to closely receive said core of said cable, slidably housed within said body proximal to said one end thereof, said mandrel having a sleeve adapted to engage the cable beneath said jacket, contacting said foil, to thereby stretch and increase the outer diameter of the jacket to a diameter greater than the internal diameter of the bushing, the sleeve being engageable with the cable by pushing the mandrel and the cable together;

said mandrel being movable longitudinally within said body from a first position in which the sleeve is not surrounded by the bushing whereby the sleeve may be engaged to the cable, to a second position via an intermediate position in both of which positions the sleeve is at least partially within the bushing whereby the jacket frictionally engages the bushing to retain the cable in the connector the mandrel being displaced to the intermediate position by pulling the cable away from the connector after engagement of the cable with the mandrel, and the mandrel being displaced to the second position by screwing the connector onto the coupling unit.

2. A connector as recited in claim 1, wherein said bushing and said annular mandrel are rotatable within said connector body.

3. A connector as recited in claim 2, wherein said body has an internal recess receiving said annular mandrel, restraining the longitudinal movement thereof between said first position and second position.

4. A connector as recited in claim 3, wherein said mandrel has a collar received in said internal recess of said body, said collar abutting the end wall of said recess proximal to said other end of said body indicating when said connector has been screwed onto said coupling unit such that said mandrel has reached said second position.

5. A connector as recited in claim 1, 3 or 4 further comprising an O-ring housed within said body proximal said other end thereof, of a diameter to form a close fitting seal with said cable.

6. A connector as recited in claim 4, wherein said collar is provided by a generally disc shaped element having flattened edges adapted to be inserted laterally within said body and thereafter be oriented concentric thereto, and having a bore adapted to receive and lock upon said mandrel when said mandrel is subsequently inserted into said body.

7. A connector as recited in claim 6, wherein said bushing has a flared lip and wherein said body has a second internal recess adapted to receive and hold said lip of said bushing.

8. A connector as recited in claim 7, further comprising an 0-ring disposed between said bushing and said other end of said body, with said bushing in contact therewith.

9. A connector as recited in claim 8, wherein said bushing is free to move longitudinally within a constrained range, and wherein when said mandrel is displaced to said second position with said cable mounted thereon, said bushing is displaced towards said other end to bear upon said 0-ring so as to compress said 0-ring longitudinally thereby causing said 0-ring to seal more tightly to said jacket.

10. A connector as recited in claim 1, 3 or 8, wherein said sleeve of said mandrel is tapered and barbed to facilitate engagement with said cable and inhibit subsequent disengagement.

11. A connector for use with a coaxial cable of the type having a core with a central wire conductor and a foil conductor and having a deformable outer insulating jacket, said connector also being for use with a coupling unit, said connector comprising:

a generally cylindrical body open at both ends, having a mating portion at one end engageable with said coupling unit, and at the other end being adapted to receive said cable;

a bushing with a bore of a diameter to closely receive said cable, mounted within said body proximal to said other end thereof;

an annular mandrel with a bore of a diameter to closely receive said core of said cable, housed within said body proximal to said one end thereof, said mandrel having a sleeve adapted to engage the cable beneath said jacket, contacting said foil, to thereby stretch and increase the outer diameter of the jacket to a diameter greater than the internal diameter of the bushing, the sleeve being engageable with the cable by pushing the mandrel and the cable together;

said mandrel being movable longitudinally within said body from a receiving position in which the sleeve is not surrounded by the bushing whereby the sleeve may be engaged to the cable, to a holding position in which the sleeve is at least partially within the bushing whereby the jacket is frictionally engaged by the bushing to retain the cable in the connector, the mandrel being displaced to the holding position by pulling the cable away from the connector after engagement of the cable with the mandrel.

12. A combination of a coaxial cable and a connector for use with a coupling unit, comprising:

a coaxial cable having a core with a central wire conductor and a foil conductor, and having a deformable outer insulating jacket; and a connector having a generally cylindrical body open at both ends, engageable at one end with said coupling unit, and at the other end receiving said cable, a bushing with a bore to closely receive said cable, mounted within said body proximal said other end thereof, and an annular mandrel with a bore to closely receive said core of said cable, housed within said body proximal to said one end thereof, said mandrel having a sleeve engaged with the cable beneath said jacket, contacting said foil, the jacket being stretched to a diameter greater than the internal diameter of the bushing, said sleeve being engageable with said cable by pushing the mandrel and the cable together;

and wherein by pulling on the cable engaged with the mandrel and by screwing the connector onto the coupling unit, the mandrel is movable longitudinally within said body from a position in which the sleeve is not surrounded by the bushing in which the sleeve may be engaged to the cable, to a position in which the sleeve is at least partially within the bushing in which the jacket frictionally engages the bushing to retain the cable in the connector.

* * * * *